US006554147B1

(12) United States Patent
Maida, Jr. et al.

(10) Patent No.: US 6,554,147 B1
(45) Date of Patent: Apr. 29, 2003

(54) HINGE SYSTEM FOR SELF-LOCKING PERIMETER SEALING CONTAINER

(75) Inventors: Samuel Maida, Jr., Milford, CT (US); Robert Sellari, Huntington, CT (US)

(73) Assignee: Inline Plastics Corporation, Shelton, CT (US)

( * ) Notice: Subject to any disclaimer, the term of this patent is extended or adjusted under 35 U.S.C. 154(b) by 0 days.

(21) Appl. No.: 10/151,058

(22) Filed: May 17, 2002

Related U.S. Application Data

(60) Provisional application No. 60/292,396, filed on May 21, 2001.

(51) Int. Cl.[7] ..... B65D 1/22

(52) U.S. Cl. ..... 220/4.23; 220/838; 220/839

(58) Field of Search ..... 220/4.23, 837–839, 220/840

(56) References Cited

U.S. PATENT DOCUMENTS

| | | | | |
|---|---|---|---|---|
| 3,551,940 | A | | 1/1971 | Edison |
| 3,616,487 | A | | 11/1971 | Dearth |
| 3,629,901 | A | * | 12/1971 | Wolf et al. ..... 16/227 |
| 3,710,975 | A | | 1/1973 | Jansen |
| 4,127,189 | A | | 11/1978 | Shumrak et al. |
| 4,183,446 | A | | 1/1980 | Davis |
| 4,753,351 | A | | 6/1988 | Guillin |
| 4,771,934 | A | | 9/1988 | Kalmanides |
| 4,886,204 | A | | 12/1989 | Kalmanides |
| 4,892,220 | A | | 1/1990 | Foos |
| 4,901,884 | A | | 2/1990 | Kallenbach |
| 4,962,854 | A | | 10/1990 | Ricci |
| 5,046,659 | A | | 9/1991 | Warburton |
| 5,092,479 | A | | 3/1992 | Wells |
| 5,131,551 | A | | 7/1992 | Wells |
| 5,242,696 | A | | 9/1993 | McDevitt |
| 5,257,708 | A | * | 11/1993 | Dubach ..... 220/827 |
| 5,269,430 | A | | 12/1993 | Schlaupitz et al. |
| 5,339,973 | A | | 8/1994 | Edwards et al. |
| 5,358,151 | A | * | 10/1994 | Strasenburgh ..... 222/420 |
| 5,366,104 | A | | 11/1994 | Armstrong |
| 5,405,009 | A | | 4/1995 | Hackenbracht |
| 5,413,239 | A | | 5/1995 | Rider, Jr. |
| 5,437,383 | A | * | 8/1995 | Stull ..... 215/235 |
| 5,441,150 | A | | 8/1995 | Ma |
| 5,456,379 | A | | 10/1995 | Krupa et al. |
| 5,515,993 | A | | 5/1996 | McManus |
| 5,518,133 | A | | 5/1996 | Hayes et al. |
| 5,531,349 | A | * | 7/1996 | Wojcik et al. ..... 220/838 |
| 5,577,627 | A | | 11/1996 | Richie-Dubler |
| 5,584,408 | A | | 12/1996 | Orkisz |
| 5,605,244 | A | | 2/1997 | Bradshaw |
| D394,985 | S | | 6/1998 | Curtis et al. |
| 5,762,231 | A | | 6/1998 | Rider, Jr. et al. |
| 5,860,530 | A | | 1/1999 | Simmons et al. |
| 5,860,549 | A | | 1/1999 | Allers et al. |
| 5,862,930 | A | | 1/1999 | Orkisz |
| D407,015 | S | | 3/1999 | Jones |
| 5,897,011 | A | | 4/1999 | Brilliant et al. |
| 5,906,292 | A | | 5/1999 | Rider, Jr. |
| 5,938,068 | A | | 8/1999 | Atkins et al. |
| 5,950,854 | A | | 9/1999 | Rider, Jr. et al. |
| 5,979,687 | A | | 11/1999 | Hayes et al. |
| 6,032,827 | A | | 3/2000 | Zettle et al. |
| 6,042,000 | A | | 3/2000 | Kawamoto |
| 6,056,138 | A | | 5/2000 | Chen |
| 6,102,231 | A | | 8/2000 | Rider, Jr. et al. |

* cited by examiner

*Primary Examiner*—Joseph M. Moy
(74) *Attorney, Agent, or Firm*—Melvin I. Stoltz

(57) ABSTRACT

By providing an elongated, flexible hinge which extends between one edge of the base and an adjacent edge of the lid or cover, with the hinge being constructed for controlling the arcuate pivoting movement of the lid relative to the base, a uniquely constructed, self-sealing, perimeter, clam-shell container is realized. By precisely controlling the arcuate path through which the lid moves relative to the base, as well as maintaining precisely controlled positions and orientations, automatic engagement of the cooperating ridge and groove of each component is realized, and complete engagement of the ridge and groove is attained.

18 Claims, 5 Drawing Sheets

HINGE SYSTEM FOR SELF-LOCKING PERIMETER SEALING CONTAINER

RELATED APPLICATIONS

This application relates to U.S. Provisional Patent Application Serial No. 60/292,396, filed May 21, 2001 for a Hinge System for Self Locking Perimeter Sealing Container.

TECHNICAL FIELD

This invention relates to product holding containers and, more particularly, to top and bottom integrated containers having a clam-shell construction.

BACKGROUND ART

In order to provide consumers with the ability to purchase food products, particularly fresh baked food products, numerous packaging systems have been developed for enhancing the freshness of such products. In addition, automated closing and sealing systems for such containers have also been developed in order to enhance the speed for filling, closing, and sealing these containers.

Although many different container designs exist for food products, the most popular is the clam-shell design where a product holding base and a cover or lid are interconnected along one flexible edge or hinge. In addition, although many sealing or closure systems have been developed for these containers, one system which is popular and widely used is the perimeter seal, wherein the base and lid or cover comprise a mating ridge and groove formed on each component which peripherally surround the outer edge or perimeter thereof. In this way, when the lid or cover is mounted in secure engagement with the base, the perimeter seal peripherally surrounds the closed container providing the desired enhanced closure thereof.

Although perimeter sealing containers are popular and have been widely used for many products, these prior art systems typically suffer from several common failures. The most notable failure is the inability of the sealing zone adjacent the flexible hinge to be able to seal automatically when the lid is moved into engagement with the base.

Due to the typical construction employed for the hinge in the prior art, the sealing zone remains open along the edge adjacent the hinge, while the front edge is locked in place. As a result, special effort must be expended to secure the rear sealing zone, which typically requires a labor intensive closing step.

Therefore, it is a principal object of the present invention to provide a clam-shell container incorporating a perimeter seal wherein arcuate closing movement of the lid relative to the base simultaneously causes the sealing zone of the lid and base adjacent the container hinge to be automatically brought into sealing engagement.

Another object of the present invention is to provide a clam-shell container incorporating a perimeter seal having the characteristic features described above which is capable of being completely sealed by arcuately pivoting the lid relative to the base in a one-step operation with the securing of the front edge.

Another object of the present invention is to provide a clam-shell container incorporating a perimeter seal having the characteristic features described above which is highly advantageous for use in automated filling and closing systems.

Another object of the present invention is to provide a clam-shell container incorporating a perimeter seal having the characteristic features described above which is provides substantial cost savings to the user.

Other and more specific objects will in part be obvious and will in part appear hereinafter.

SUMMARY OF THE INVENTION

By employing the present invention, all of the drawbacks and difficulties found with prior art products have been eliminated, and a uniquely constructed, self-sealing, perimeter sealing, clam-shell container is realized. In the present invention, an elongated, flexible hinge extends between one edge of the base and an adjacent edge of the lid or cover, with the hinge being constructed for controlling the arcuate pivoting movement of the lid relative to the base. By precisely controlling the arcuate path through which the lid moves relative to the base, as well as maintaining precisely controlled positions and orientations, automatic engagement of the cooperating ridge and groove of each component is realized, and complete engagement of the ridge and groove is attained.

In order to achieve this desirable result, which has heretofore been unattainable with prior art container constructions, the clam-shell container of the present invention incorporates an elongated hinge member which is cooperatively associated with a base, having a peripherally surrounding ridge, and a lid or cover which incorporates a mating, peripherally surrounding groove constructed for locked interengagement with the ridge of the base. Furthermore, in order to attain the desired automatic engagement of the ridge and groove along the portion of the base and lid adjacent the hinge, the hinge member of the present invention comprises a flange portion extending outwardly from the ridge and an integrally formed, arcuately curved flexing portion extending between the flange and the groove of the lid.

By employing this construction, along with the precise positioning of the components thereof, controlled arcuate movement of the lid relative to the base is attained with the groove of the lid being controllably securely engaged with the ridge of the base as the lid is pivoted into locked engagement with the base. In this way, the portion of the container directly adjacent the hinge member is automatically secured and locked in full engagement with the ridge of the base as the lid is arcuate pivoted from its open position to its closed position.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

By referring to FIGS. 1–5 along with the following detailed disclosure, the construction and operation of the perimeter sealing container and hinge assembly of the present invention can best be understood. Although these figures depict the preferred embodiment for the present invention, alternate embodiments can be employed without deviating from the scope of the present invention. Consequently, it is to be understood that the following figures depict the preferred embodiment for exemplary purposes only, and all alternate constructions are intended to be within the scope of this invention.

Figure 1:
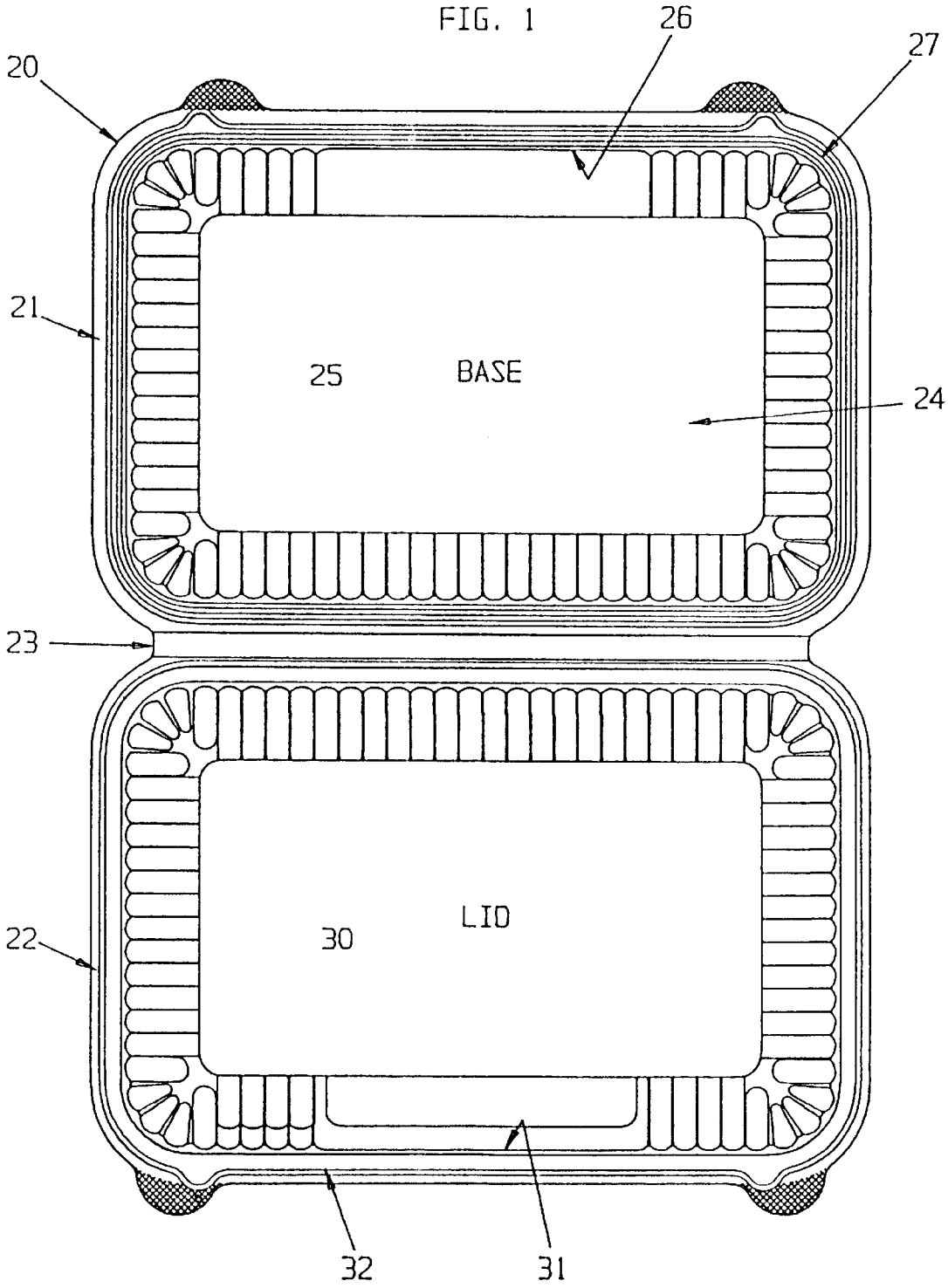
FIG. 1 is a top plan in view of the clam-shell container of the present invention shown in the open position.
Figure 2:
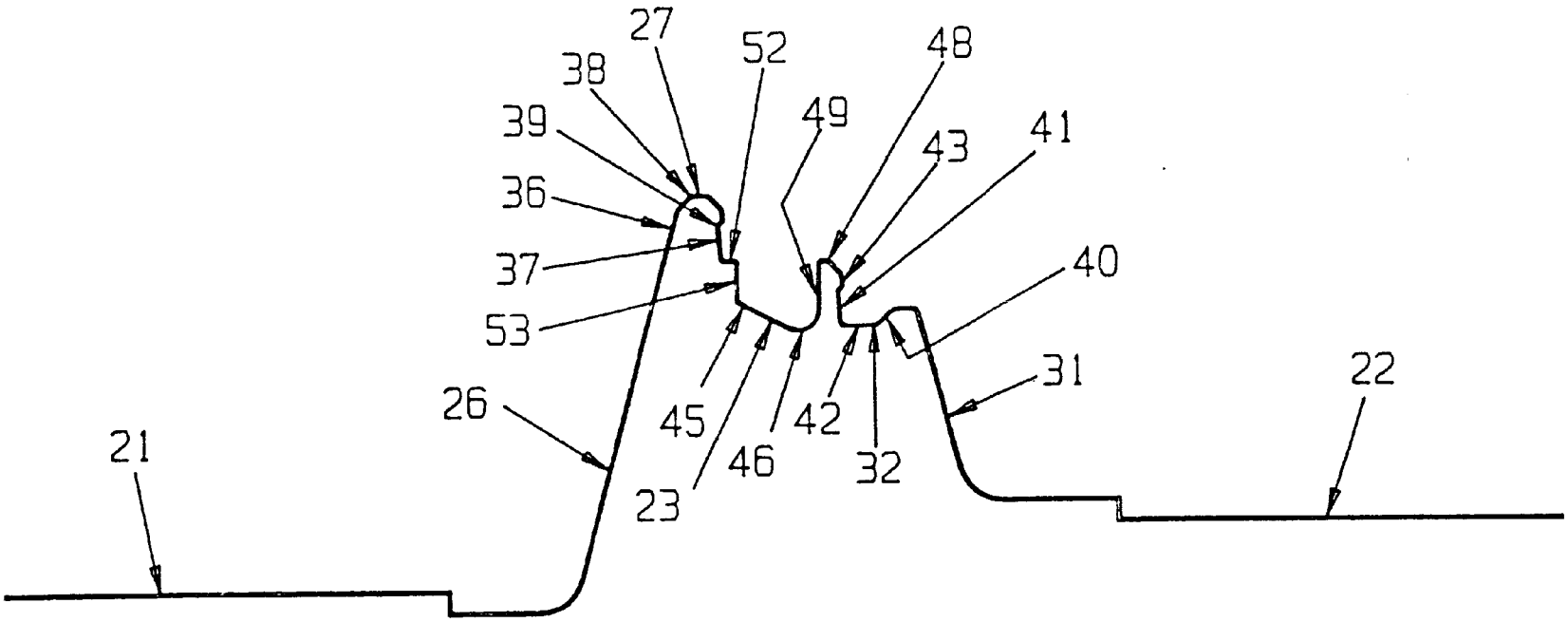
FIG. 2 is a cross-sectional, side elevation view of the clam-shell container of FIG. 1 shown in its open position and taken along line 1—1 of FIG. 1.
Figure 3:
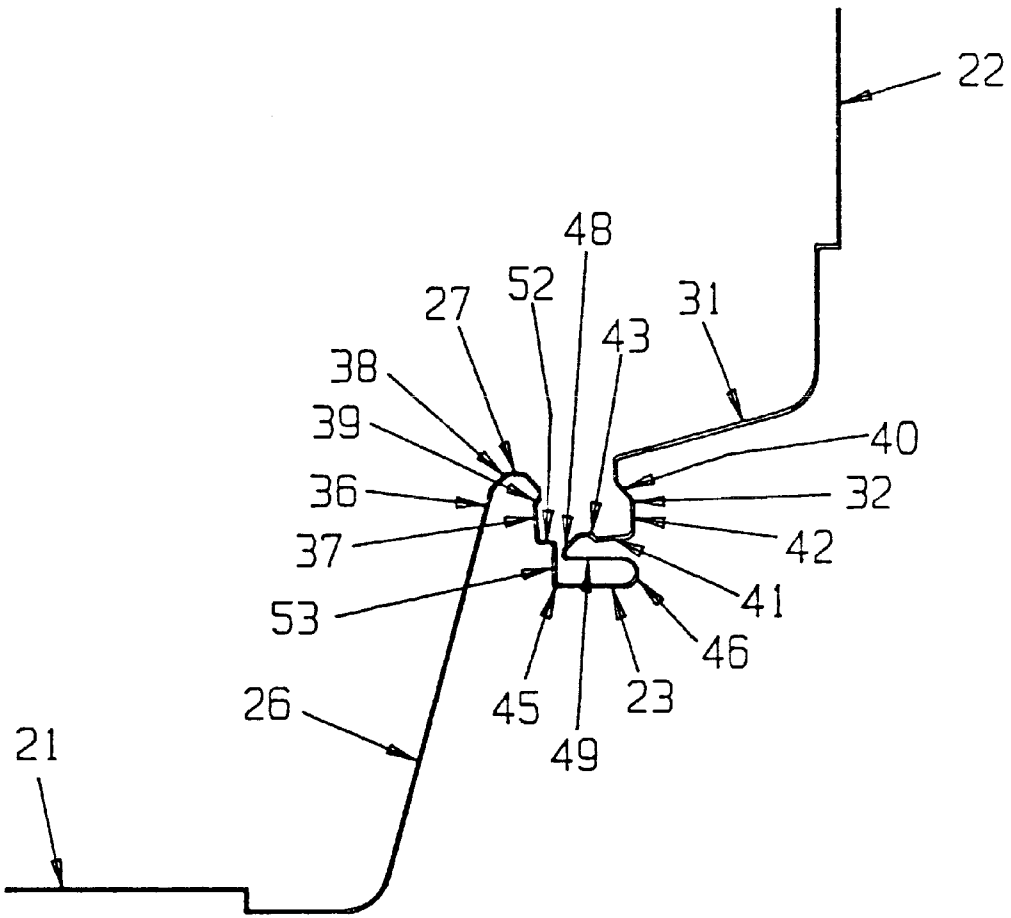
FIG. 3 is a cross-sectional, side elevation view of the clam-shell container of FIG. 1 shown with the lid/cover arcuately pivoted through an arc of about 90°.
Figure 4:
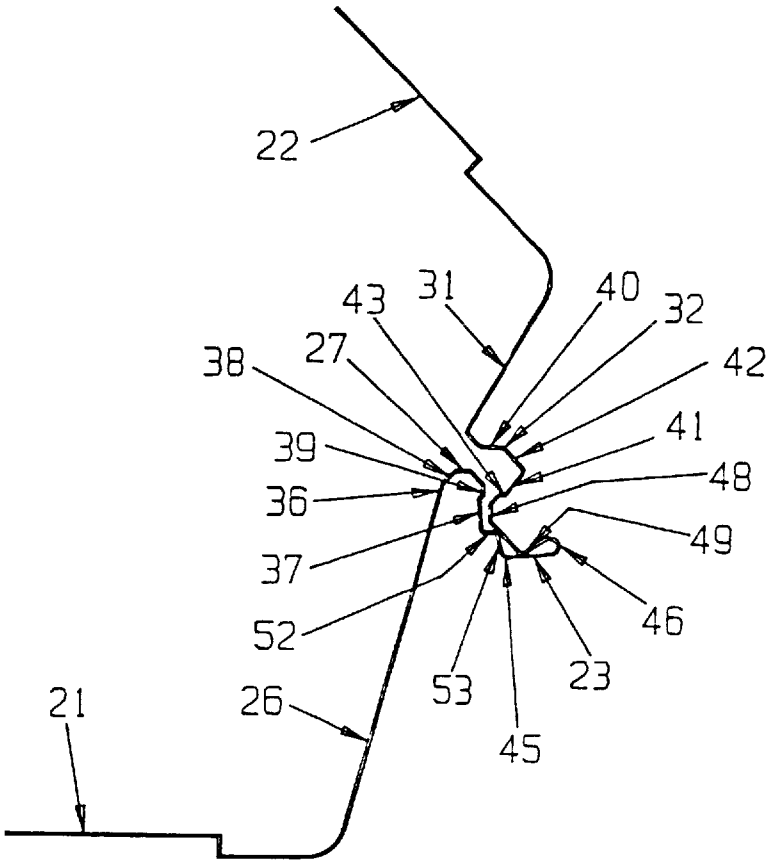
FIG. 4 is a cross-sectional, side elevation view of the clam-shell container of FIG. 1 shown with the lid cover arcuately pivoted through an arc of about 135°.
Figure 5:
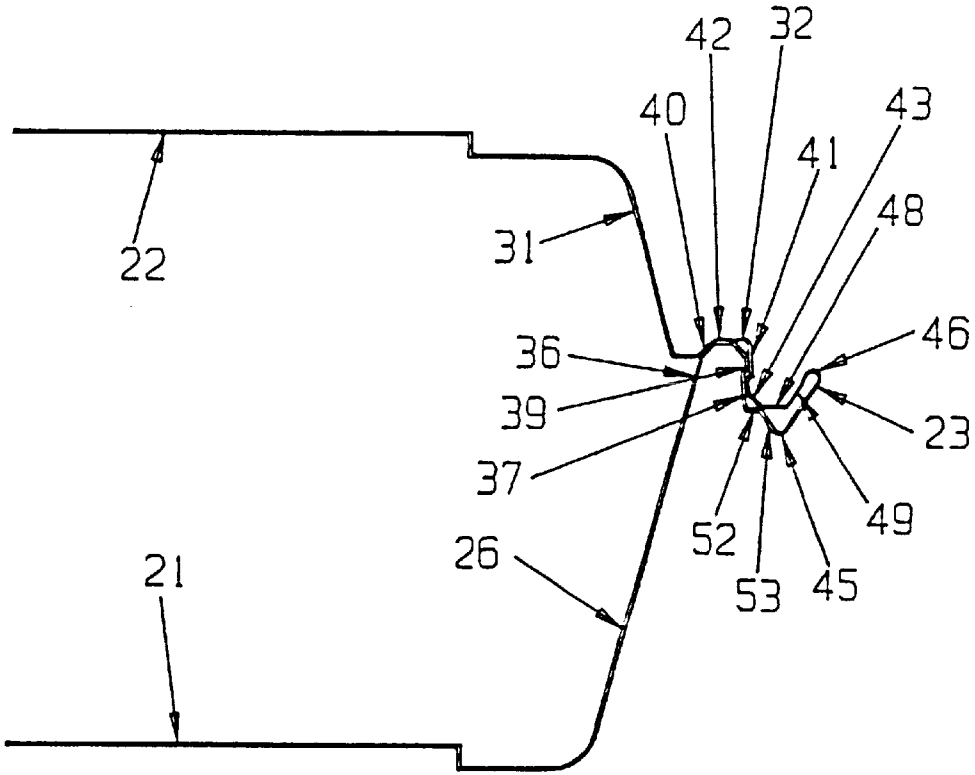
FIG. 5 is a cross-sectional, side elevation view of the clam-shell container of FIG. 1 shown with the lid cover arcuately pivoted through an arc of about 180° into its closed position.

As shown in FIGS. 1–5, clam-shell container 20 comprises base 21 and lid or cover 22 which is interconnected to base 21 by elongated hinge member 23. As shown, hinge member 23 is integrally connected to base 21 and lid 22, thereby forming the desired clam-shell construction. In addition to securely maintaining lid 22 attached to base 21, this construction enables lid 22 to be arcuately pivoted from its open position, as shown in FIGS. 1 and 2, to its closed and sealed position, as depicted in FIG. 5.

In the preferred construction, base 21 comprises a product retaining zone 24 which is formed by support surface 25 and upstanding wall 26 which surrounds support surface 25. In addition, a ridge 27 extends upwardly from the terminating end of wall 26, peripherally surrounding support surface 25 and providing one of the components for the sealing closure of container 20.

Lid or cover 22 preferably comprises a top surface 30 which is integrally interconnected with wall 31 which peripherally surrounds top surface 30. In addition, a continuous groove 32 is formed in the terminating end of wall 31, with groove 32 being constructed for cooperating, mating, inter-engagement with upstanding ridge 27 of wall 26 of base 21. By employing this construction, once lid/cover 22 is pivoted into the closed position, ridge 27 and groove 32 are secured in locked inter-engagement with each other, providing the desired sealing closure of container 20.

As best seen in FIG. 2, ridge 27 is preferably constructed by incorporating a pair of juxtaposed, spaced, facing, sloping wall portions 36 and 37, each of which are cooperatingly engaged and blended with arcuately curved peak portion 38. In addition, in the preferred embodiment, wall portions 36 and 37 are both slanted towards or slope towards peak portion 38, forming the desired configuration for continuous, peripherally surrounding ridge 27. In addition, outwardly extending step portion 39 is formed between peak 38 and wall portion 37 for providing sealing engagement with a cooperating step portion formed in groove 32, as detailed below.

Although this construction is preferred, alternate constructions may be employed, such as having wall portions 36 and 37 formed in substantially parallel, juxtaposed, spaced relationship. However, regardless of the configuration employed, all alternate embodiments are intended to be within the scope of this invention.

In order to provide a mating, sealing and inter-engageable construction, groove 32 of lid/cover 22 comprises juxtaposed, spaced, facing, sloping wall portions 40 and 41, each of which are cooperatingly engaged and blended with arcuately curved recess surface 42. In the preferred embodiment, wall portions 40 and 41 both slope towards recess surface 42, thereby forming the desired configuration for establishing peripherally surrounding groove 32 of lid/cover 22.

In addition, wall portions 40 and 41 may comprise alternate orientations and configurations, as detailed above in reference to ridge 27. However, regardless of which configuration is employed, wall portions 40 and 41 of groove 32 must be constructed for cooperating, mating inter-engagement with wall portions 36 and 37 of ridge 27. In this way, the desired mating, sealed engagement of perimeter sealing container 20 is achieved.

In order to assure and enhance the mating, sealing engagement of groove 32 with ridge 27, groove 32 also comprises outwardly extending step portion 43, formed at the base of wall portion 41. Preferably, step portion 43 is positioned for cooperating engagement with wall 37 of ridge 27 for engagement directly below step portion 39. By employing this construction, step portion 43 and step portion 39 sealingly engage with each other, thereby assuring secure sealing engagement of groove 32 and ridge 27. Finally, the preferred construction of groove 32 is completed by forming wall 48 adjacent step portion 41 to define the terminating end of one side of groove 32. In addition, substantially flat connecting wall 49 extends from end wall 48 to arcuately curved portion 46 of hinge 23, thereby completing the overall construction of container 20.

In accordance with the present invention, hinge member 23 comprises a unique construction in order to achieve the desired secure, automatic, mating, sealing inter-engagement of the portions of groove 32 and ridge 27 which are adjacent hinge member 23, as lid/cover 22 is arcuately pivoted from its open position to its closed position. As discussed above, by constructing hinge member 23 with flange portion 45 and flexible, arcuately curved portion 46, hinge member 23 is capable of achieving the desired positioning of groove 32 in cooperating alignment with ridge 27 for assuring secure, interconnected, mating inter-engagement of these components simultaneously with the movement of lid/cover 22 onto base 21 for closure thereof.

In the preferred embodiment, flange portion 45 and arcuately curved, flexible portion 46 are integrally interconnected with each other, forming a substantially single, fully integrated hinge member 23. Although this construction is preferred, alternate configurations may be employed without departing from the scope of this invention. In addition, in the preferred construction, flange portion 45 of hinge member 23 is connected to wall portion 37 of ridge 27 by step surface 52 and wall 53. Preferably, step surface 52 and wall 53 are formed at substantially right angles to each other, with step surface 52 extending outwardly from the terminating end of wall portion 37 at an angle of substantially 90°. As a result, wall 53 and wall portion 37 are substantially parallel to each other, spaced apart by the width of step surface 52. In the preferred construction, wall 53 extends form step surface 52 to flange portion 45 with a vertical distance ranging between about 0.140 and 0.200 inches.

Furthermore, in the preferred embodiment, flange portion 45 extends from wall 53 at an angle ranging between about 100° and 140° with an angle of between about 110° and 130° being optimum. In addition, connecting wall 49 and wall 53 are formed substantially parallel to each other and spaced apart a distance substantially equal to between about 0.325 and 0.400 inches.

Finally, in completing the preferred construction of hinge member 23 when the container is in the open position, hinge member 23 is formed with the material thereof being thinner than the material forming container 20. As a result, hinge 23 comprises a depth or thickness/thinness which is less than the thickness of base 21 and lid/cover 22.

By employing this construction, the portion of groove 32 which is directly adjacent hinge member 23 is maintained in the precisely desired positioning for enabling groove 32 to be arcuately pivoted relative to ridge 27 in a manner which assures that groove 32 is brought into direct, sealing engagement with ridge 27 as lid/cover 22 is pivoted from its open position, as depicted in FIG. 2, to its closed position, as depicted in FIG. 5. In this regard, FIG. 3 depicts lid/cover 22 arcuately pivoted through about 90° relative to base 21, while FIG. 4 depicts lid/cover 22 pivoted through an arc of about 135° relative to base 21.

As is evident from a review of FIGS. 2–5, flange portion 45 of hinge member 23 maintains groove 32 of lid/cover 22, which is adjacent-hinge member 23, in a precisely defined position and orientation which assures that the arcuate movement of groove 32 directly onto ridge 27. Furthermore, step portion 43 is brought into interlocking, sealing engagement with step portion 39, enabling the sealing inter-engagement of groove 32 with ridge 27. In addition, arcuately curved, flexible portion 46 assures that the pivoting movement of lid/cover 22 is achieved in a precisely defined arcuate path which provides controlled movement of groove 32 directly into engagement and securement with ridge 27.

As a result, by employing the present invention, clamshell container 22 may be filled with any desired product and passed through automatic production equipment which causes lid/cover 22 to be arcuately pivoted from the open position to its closed position. Since hinge member 23 of container 20 assures secure, sealing inter-engagement of groove 32 of lid/cover 22 with ridge 27 of base 21 in the area directly adjacent hinge member 23, the simple locking closure of the forward edge of ridge 27 and groove 32 provides complete secure engagement of the entire perimeter seal formed about container 20. As a result, automated equipment is capable of being employed for providing filling, closing, and sealing of container 20 with a minimum of manual effort being needed.

It will thus be seen that the object set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. A container system constructed for holding and displaying product, said system comprising:

A. a base member incorporating
  a. a support surface
  b. first wall means interconnected to and peripherally surrounding the support surface, and
  c. an upstanding ridge formed in the terminating edge of the wall means and extending substantially about the entire peripheral surface thereof;

B. a cover member cooperatingly associated with the base member for forming the product container, being integrally interconnected with the base member along one edge to form a clamshell configuration, and incorporating
  a. a substantially flat surface
  b. second wall means interconnected to and peripherally surrounding the flat surface, and
  c. a groove member
    1. formed in the terminating edge of the second wall means,
    2. extending substantially about the entire peripheral surface thereof, and
    3. constructed for cooperating, mating engagement with the ridge of the base member; and C. a hinge member interconnecting the base member to the cover member along said one edge and comprising
  a. a flange portion extending outwardly from the ridge of the base member, and
  b. a flexible, arcuately curved portion
    1. integrally affixed on a first edge thereof to the flange portion,
    2. extending from the flange portion to the groove member of the cover member,
    3. integrally affixed to the groove member along a second edge thereof, and
    4. constructed for providing controlled arcuate pivoting movement of the cover member relative to the base member from an open position to a closed position therewith, while causing the groove of the cover member adjacent the hinge member to automatically engage the ridge of the base member simultaneously with the arcuate closing movement, whereby a clam-shell container is achieved which enables the ridge and groove to be automatically engaged with each other without requiring a separate sealing force.

2. The container system defined in claim 1, wherein the flange portion and the flexible arcuately curved portion forming the hinge member are further defined as being interconnected with each other to form a substantially continuous, fully integrated member.

3. The container system defined in claim 2, wherein said integrated hinge member comprises a substantially flat, smooth surface throughout its entire length.

4. The container system defined in claim 3, wherein said integrated hinge member comprises a thickness which is less than the thickness of the base member and the cover member.

5. The container system defined in claim 1, wherein the ridge of the base member is further defined as comprising:
1. a first surface interconnected to the terminating edge of the first wall means,
2. a second surface formed in juxtaposed, spaced, facing relationship to the first surface, and
3. a first top surface extending between and interconnecting the first surface with the second surface.

6. The container system defined in claim 5, wherein the groove of the cover member is further defined as comprising:
1. a third surface interconnected to the terminating edge of the second wall means,
2. a fourth surface formed in juxtaposed, spaced relationship to the third surface, and
3. a second top surface extending between and interconnecting the third surface with the fourth surface.

7. The container system defined in claim 6, wherein the second surface and the fourth surface are further defined as comprising an outwardly extending locking rib or step portion formed therein, each positioned for cooperating, locking engagement with each other.

8. The container system defined in claim 6, wherein said system further comprises an outward extending step surface formed along the terminating edge of the second surface adjacent the hinge member and a first wall member affixed along a first edge thereof to the step surface and extending substantially the entire length of said step surface.

9. The container system defined in claim 8, wherein said first wall member is further defined as being affixed along a second edge thereof to the flange portion of the hinge member.

10. The container system defined in claim 9, wherein said system further comprises a second wall member affixed to the fourth surface of the groove member and positioned in juxtaposed, spaced, facing relationship therewith.

11. The container system defined in claim 10, wherein the flexible, arcuately curved portion of the hinge member is further defined as being affixed to the terminating edge of the second wall member.

12. The container system defined in claim 11, wherein said flange portion is further defined as angularly extending from the first wall member with an arcuate distance ranging between about 100° and 140°.

13. The container system defined in claim 12, wherein said arcuate distance is further defined as comprising between about 110° and 130°.

14. The container system defined in claim 11, wherein said first wall member and said second wall member are further defined as being in juxtaposed, spaced, substantially parallel relationship to each other when said container is in the open position.

15. The container system defined in claim 14, wherein said first wall member and said second wall member are further defined as being spaced apart, when the container is in the open position, a distance ranging between about 0.325 and 0.400 inches.

16. The container system defined in claim 9, wherein the first wall member is further defined as comprising a vertical height ranging between about 0.140 and 0.200 inches.

17. The container system defined in claim 1, wherein the base member and said cover member are further defined as being formed from transparent plastic material for providing complete visibility of any product retained therein.

18. The container system defined in claim 17, wherein the container is constructed by one selected from the group consisting of thermoforming and vacuum forming.

* * * * *